US006684441B2

(12) United States Patent
Mehrmann et al.

(10) Patent No.: US 6,684,441 B2
(45) Date of Patent: Feb. 3, 2004

(54) METHOD FOR THE WASHING OF LAUNDRY

(75) Inventors: Falk F. Mehrmann, Walsrode (DE); Wilhelm Bringewatt, Porta Westfalica (DE)

(73) Assignee: Pharmagg Systemtechnik GmbH, Hoya (DE)

( * ) Notice: Subject to any disclaimer, the term of this patent is extended or adjusted under 35 U.S.C. 154(b) by 0 days.

(21) Appl. No.: 10/061,682

(22) Filed: Feb. 1, 2002

(65) Prior Publication Data

US 2002/0104172 A1 Aug. 8, 2002

(30) Foreign Application Priority Data

Feb. 7, 2001 (DE) ..... 101 05 820

(51) Int. Cl.[7] ..... D06F 23/02

(52) U.S. Cl. ..... 8/158; 8/159; 68/24; 68/58; 68/145

(58) Field of Search ..... 8/158, 159; 68/24, 68/27, 58, 143, 145

(56) References Cited

U.S. PATENT DOCUMENTS 2,645,914 A * 7/1953 Sessions ..... 68/58 X
3,869,883 A * 3/1975 Rotter
RE30,214 E * 2/1980 Bhavsar
4,478,060 A * 10/1984 Gruenwald
4,494,265 A * 1/1985 Schmidt et al.
4,829,792 A * 5/1989 Keith
5,025,645 A * 6/1991 Eck et al.
5,211,039 A * 5/1993 Pellerin
5,426,958 A * 6/1995 Sheppard

FOREIGN PATENT DOCUMENTS

| | | | |
|---|---|---|---|
| DE | 43 31 704 | A1 | 2/1995 |
| DE | 44 22 631 | A1 | 1/1996 |
| DE | 198 12 386 | A1 | 9/1999 |
| DE | 199 24 873 | A1 | 11/2000 |
| EP | 0 636 731 | A1 | 2/1995 |
| EP | 0 731 202 | A1 | 9/1996 |

OTHER PUBLICATIONS

Copy of Examination Report from German Patent Office.
Copy of Examination Report from European Patent Office.

* cited by examiner

*Primary Examiner*—Frankie L. Stinson
(74) *Attorney, Agent, or Firm*—Technoprop Colton LLC

(57) ABSTRACT

The invention provides a method for the washing of items of laundry (11), in which only the items of laundry (11) are transferred from the last washing chamber (18) into the first rinsing chamber (19), without the washing liquid. As a result, the washing liquid cannot pass into the rinsing zone (15), and the method according to the invention thus prevents mixing of different treatment liquids. As a result, an effective treatment of the items of laundry (11), in particular a more effective rinsing thereof, is possible.

9 Claims, 3 Drawing Sheets

METHOD FOR THE WASHING OF LAUNDRY

BACKGROUND OF THE INVENTION

1. Technical Field

Figure 1:
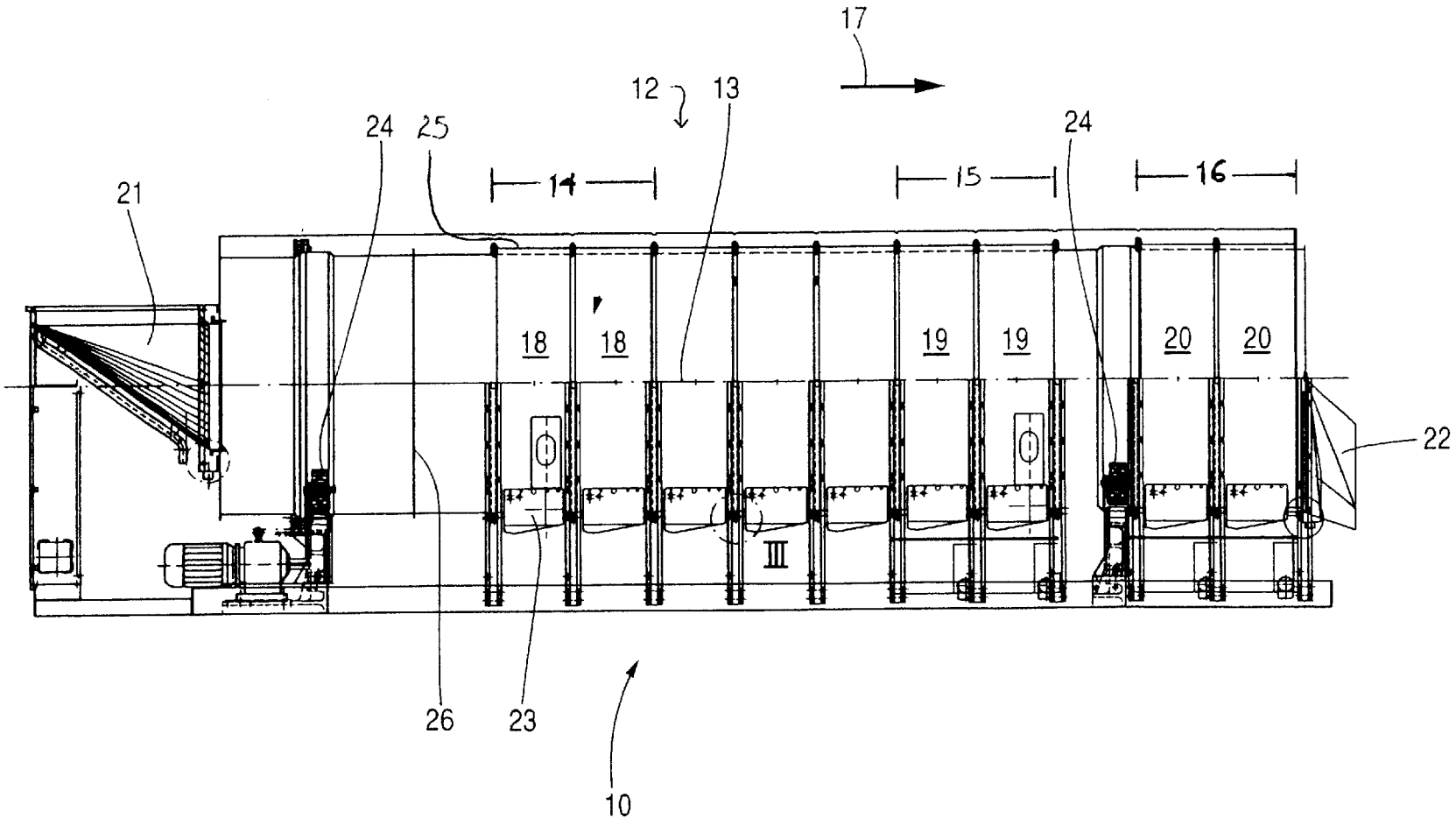

The invention relates to a method for the washing of, in particular, items of laundry by washing laundry in a treatment liquid in a drum that can be driven in a rotating manner and has successive treatment chambers through which the items of laundry are transferred.

2. Prior Art

The invention relates, in particular, to the washing and subsequent after-treatment, for example, rinsing and/or finishing, of items of laundry in commercial laundries. In commercial laundries, use is made of washing machines, in particular continuous-process washing machines, which have an elongate drum which can be driven in a rotating manner. The items of laundry or other articles to be treated are conducted along in the treatment direction through the drum and in the process are at least washed and rinsed. If appropriate, following the rinsing, finishing of the items of laundry takes place in the washing machine.

The washing and the subsequent treatment of the items of laundry in the washing machine takes place using a treatment liquid. This is, as a rule, water which is provided with the additives required for washing, rinsing and, if appropriate, finishing. As a rule, the washing takes place in a different treatment liquid than the subsequent rinsing. In the case of known washing machines, the treatment liquid is conducted, together with the items of laundry, through the individual treatment stations in the drum, specifically, in particular, through the washing station and the rinsing station or through the chambers formed for this purpose within the drum. The consequence is a continuous mixing of different treatment liquids and dirt-laden treatment liquids.

A BRIEF SUMMARY OF THE INVENTION

Taking the above as the starting point, the invention is based on the object of providing a method for the washing of, in particular, items of laundry, with which an individual treatment of the items of laundry is possible, specifically without a significant mixing, or at least only a slight mixing, of the different treatment liquids used for the particular treatment.

A method for achieving this object has the measures of claim 1. By virtue of the fact that the items of laundry are transferred at least from one treatment chamber to the following treatment chamber essentially without the treatment liquid which is not tied up in the items of laundry, namely without the "free detergent solution", a significant mixing of the treatment liquid in different chambers, in particular, different treatment zones, is avoided. Only the treatment liquid present in the wet items of laundry, the "tied-up detergent solution", passes, in the case of the method according to the invention, into the next chamber or to the next treatment zone. In this procedure, the carrying-along of dirt-laden treatment liquids into the next treatment chamber or treatment zone is also effectively avoided, or at least reduced.

The method according to the invention is preferably used in the case of transferring the items of laundry from the washing zone, in particular clear washing zone, to the following rinsing zone, in that the items of laundry are transferred into the rinsing zone without the free wash water.

This makes it possible to keep detergent from the washing zone out of the rinsing zone, apart from small quantities of detergent in the tied-up detergent solution. The items of laundry are preferably transferred from the chamber, or in the case of a number of chambers, from the last chamber, of the clear washing zone to the chamber of the rinsing zone, or to a first chamber of a rinsing zone having a number of chambers, without the free detergent solution, i.e. without the washing liquid present in the clear washing zone.

The transferring of the items of laundry from one treatment zone to the adjacent treatment zone, or from one chamber into the following chamber, expediently takes place after the items of laundry have been separated at least for the most part, preferably completely, from the free detergent solution, in that chamber from which they are transferred into the following chamber.

Furthermore, provision is made to draw off the free detergent solution from the particular treatment chamber before the items of laundry are transferred into the following treatment chamber. This ensures that during the transfer none of the free detergent solution remains in the chamber and is transferred together with the items of laundry into the following chamber.

According to an advantageous development of the method according to the invention, the drum continues to be driven in a rotating manner, specifically preferably in the manner used for the washing and/or rinsing, during the drawing-off of the free detergent solution as a result of the items of laundry being transferred into the adjacent treatment zone and/or treatment chamber. In this connection, some of the tied-up detergent solution is removed from the items of laundry. This tied-up detergent solution which is partially separated from the laundry during spinning can then be removed together with the free detergent solution, before the laundry is transferred into the following treatment zone and/or treatment chamber thereof. The further driving of the drum can proceed in such a manner that it is maintained not only during the drawing-off of the free detergent solution; rather, it also extends over a subsequent period of time, with the result that the treatment liquid still running out of the items of laundry after the free detergent solution has been drawn off can still be drawn off like the free detergent solution after the complete draining-away of the actual free detergent solution.

The method according to the invention is particularly suitable for the transfer of the items of laundry in the case of washing machines having a drum which has chambers, the transferring of the items of laundry taking place in accordance with the "bottom transfer" principle.

A BRIEF DESCRIPTION OF THE DRAWINGS

Figure 2:
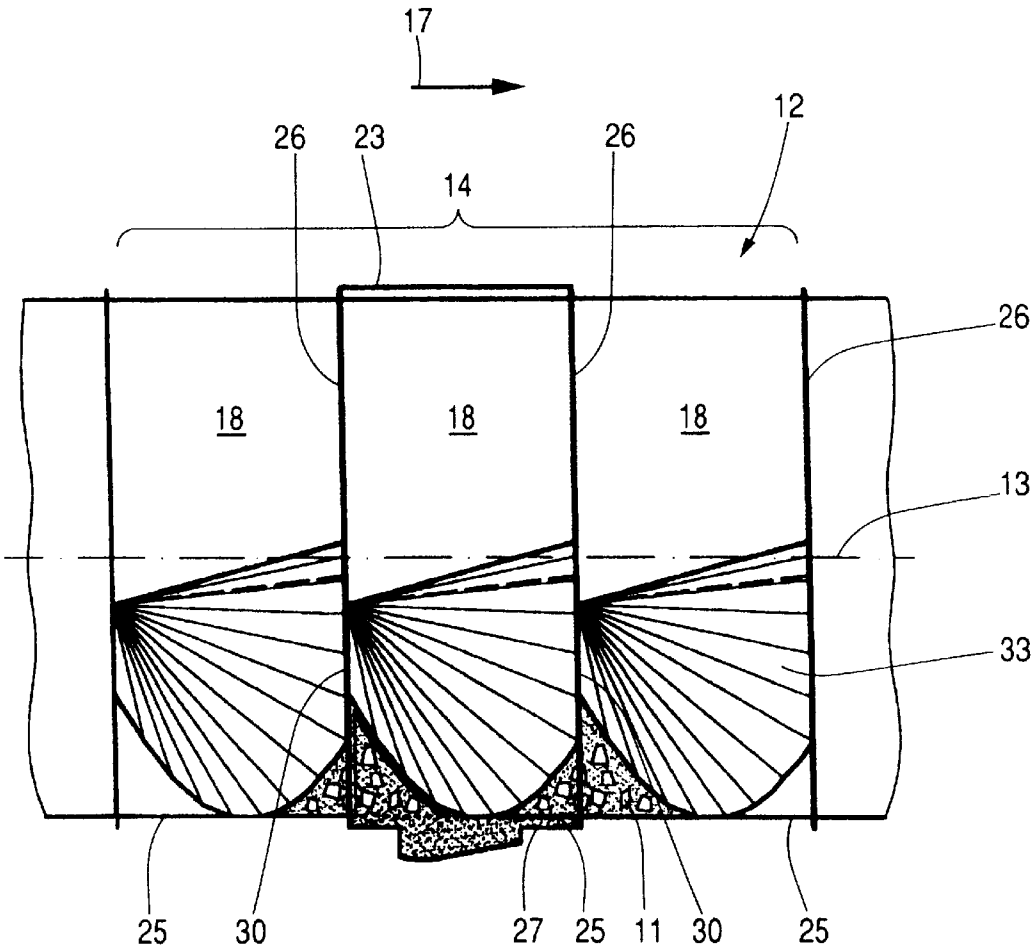
Figure 3:
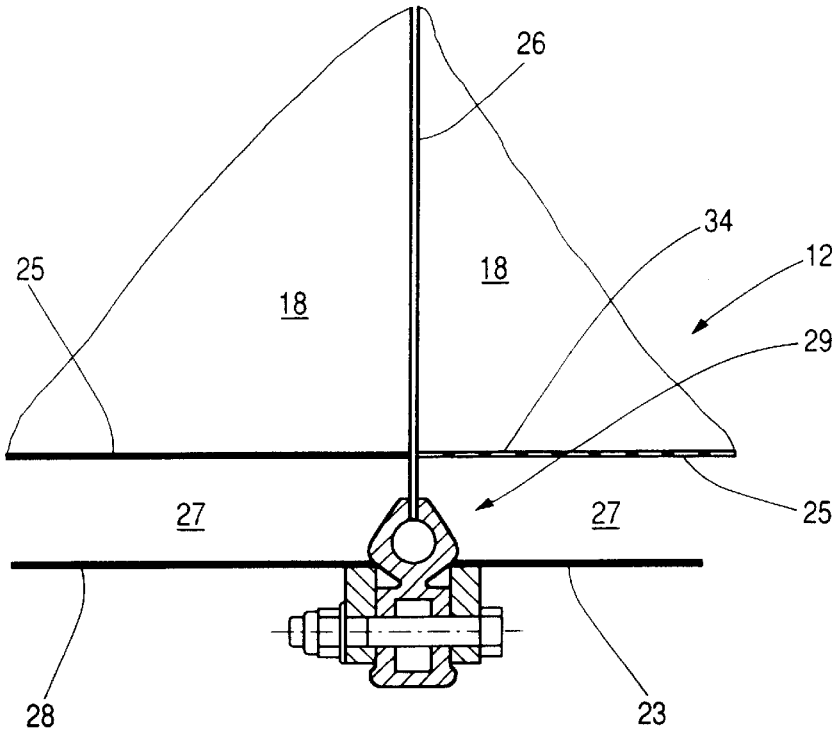
Figure 4:
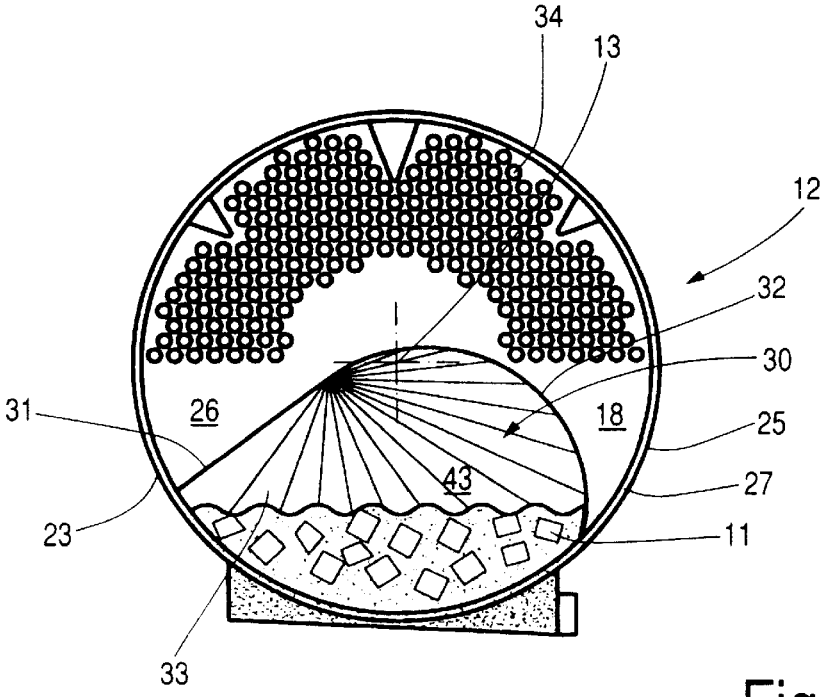

A preferred exemplary embodiment of the invention will be explained in greater detail below with reference to a continuous-process washing machine illustrated by way of example in the drawing. In the drawing:

FIG. 1 shows a detailed side view of the continuous-process washing machine, FIG. 2 shows an enlarged cross section through three chambers of the continuous-process washing machine, FIG. 3 shows a detail III, illustrated on an enlarged scale, from FIG. 1, and FIG. 4 shows a cross section through the continuous-process washing machine with a view of a partition and an outlet opening in a transfer position.

A DETAILED DESCRIPTION OF THE PREFERED EMBODIMENTS

The continuous-process washing machine 10 which is shown in the figures is designed for use in commercial laundries. In the continuous-process washing machine 10, the items of laundry 11, which are indicated symbolically in FIG. 4 by squares, are washed, rinsed, and, if appropriate, subjected to a subsequent after-treatment, for example, to a finishing process, in batches.

The continuous-process washing machine 10 has an elongate drum 12. The drum 12 can be driven in a rotating manner about a horizontal central longitudinal axis 13, specifically preferably in opposite directions. The drum 12 of the continuous-process washing machine 10 shown here is divided into different zones. Located at the start of the drum 12 is a washing zone 14, which is usually composed of a pre-washing zone and a following clear washing zone. The washing zone 14 is followed by the rinsing zone 15 and subsequently a finishing zone 16. The finishing zone 16 may optionally be omitted. The washing zone 14, the rinsing zone 15 and the finishing zone 16 are arranged consecutively in the treatment direction 17 in the drum 12 of the continuous-process washing machine 10. In the exemplary embodiment shown, at least the washing zone 14 and the rinsing zone 15 are in each case formed from a number of washing chambers 18 and rinsing chambers 19 which are consecutive in the treatment direction 17, i.e. along the longitudinal central axis 13 of the drum. The number of consecutive washing chambers 18 and rinsing chambers 19 can vary depending on the size and efficiency of the continuous-process washing machine 10. The invention is therefore not restricted to the exemplary embodiment shown here of the continuous-process washing machine 10, which has five washing chambers 18 and five rinsing chambers 19. In this case, the two washing chambers 18 which are situated at the front in the treatment direction 17 are used as pre-washing chambers, while the three following washing chambers 18 are used as clear washing chambers. The finishing zone 16 of the continuous-process washing machine 10 shown here has two finishing chambers 20. However, it is conceivable not to have any finishing chamber 20 following the rinsing zone 15 or the last rinsing chamber 19. If appropriate, the last rinsing chamber 19 may also be used as the finishing chamber.

An input funnel 21 is provided in front of the drum 12 of the continuous-process washing machine 10. Via the input funnel 21, items of laundry 11 to be washed can be conveyed into the washing zone 14 of the continuous-process washing machine 10, specifically into the front washing chamber 18, as seen in the treatment direction 17. An output chute 22 is preferably provided at the rear end of the continuous-process washing machine 10. Via the output chute 22, ready-washed and, if appropriate, finished items of laundry 11 can be transported out of the continuous-process washing machine 10, specifically, if appropriate, into a following water-removing device (not shown), for example, a water-removing press.

The drum 12 of the continuous-process washing machine 10 shown is partially surrounded by a liquid-tight outer drum 23. The outer drum 23 serves for receiving treatment liquid, in particular, water. Additives, specifically for example detergents, can be added, if appropriate, to this water. The outer drum 23 extends only over a subregion of the drum 12. In the exemplary embodiment shown here, the first two chambers of the drum 12 and the third last chamber of the drum 12 are therefore not provided with an outer drum 23 (FIG. 1). In the region of those chambers which do not have an outer drum 23, the drum 12 is supported in a rotating manner on running wheels 24. At least one of these running wheels 24 can be driven in a known manner.

The elongate drum 12, which can rotate about the horizontal longitudinal central axis 13, is of single-piece design. For this purpose, the drum 12 has a cylindrical form. The individual chambers, namely washing chambers 18, rinsing chambers 19 and finishing chambers 20, are located in the drum 12 directly following one another in the treatment direction 17. In the exemplary embodiment shown, all of the washing chambers 18, rinsing chambers 19 and finishing chambers 20 are approximately the same size and extend namely over substantially the same length section of the drum 12.

Each chamber has a cylinder jacket 25 which forms part of the drum 12 extending in the longitudinal direction. Furthermore, the drum 12 has partitions 26. These partitions 26, which are preferably of identical design to one another, are arranged at essentially the same distance from one another in planes running perpendicularly with respect to the longitudinal central axis 13 of the drum 12. As a result, each chamber is bounded by two parallel partitions 26 which are assigned to opposite end sides of the particular cylinder jacket 25 in order to form each chamber. Two consecutive cylinder jackets 25 of different chambers are therefore separated from each other by a partition 26 in each case. The partitions 26 are connected, and preferably welded in a liquid-tight manner, to those end sides of the cylinder jackets 25 of the individual chambers which are assigned to them. In this manner, the entire drum 12 is formed from a plurality of cylinder jackets 25 and partitions 26 which are consecutive in the treatment direction 17. In this case, the cylinder jackets 25 of different chambers are connected to one another by a partition 26 in each case.

The cylindrical outer drum 23 has a diameter which is somewhat larger than the outside diameter of the inner drum 12. As a result, an annular space 27 is produced between the inner drum 12 and the outer drum 23. The outer drum 23 is formed from cylinder sections 28. The cylinder sections 28, which are essentially the same size, extend over the region of an entire chamber in each case. The cylinder sections 28 are connected to one another on their end sides which face one another. A circumferential seal 29 is arranged (FIG. 3) in the region of the connection of two cylinder sections 28 in each case. The respective seal 29 bears in a sealing manner against that outer annular region of the particular partition 26 which protrudes with respect to the outside diameter of the drum 12.

The partitions 26 between adjacent chambers have an eccentric opening 30 (FIG. 4). The respective opening 30 is located essentially in one half of the partition 26, which half is situated on a side next to the longitudinal central axis 13. The opening 30 projects as far as the cylinder jacket 25 of the drum 12. For this purpose, the opening 30 starts from the circumferential region of the partition 26 and extends preferably over approximately 90° to 120° of the circumference of the partition 26. A remaining part of the opening 30 of the partition 26 is bounded by an approximately radially directed, straight edge region 31 and by an adjoining, curved edge region 32. Through the opening 30 in the respective partition 26 a chamber which is at the front in the treatment direction 17 can be unloaded and at the same time the following chamber can be loaded, specifically in each case with essentially only items of laundry 11. This manner of transferring at least the items of laundry 11 from one chamber to the other is referred to in technical jargon as "bottom transfer", for which purpose the drum 12 is brought into a position in which the particular opening 30, preferably the openings 30 in all of the partitions 26, lie equally in the region of a lower half of the drum 12, in which case the centre of that lower section of the opening 30 which is bounded by the cylinder jacket 25 of the drum 12 is located approximately perpendicularly below the longitudinal central axis (FIG. 4). It can also be seen from FIG. 4 that the partitions 26, apart from the opening 30 therein situated above it on one side, close the chambers on their end sides, specifically, in particular, entirely close them.

A blade 33 is arranged in each chamber. The blades 33 are preferably of approximately uniform design in each chamber, in that they have a three-dimensional, spiral-like or spiral-shaped profile within the relevant chamber. The respective blade 33 extends between an opening 30, which serves as an inlet opening, in a partition 26 of the relevant chamber, which partition is situated at the front with regard to the treatment direction 17, and the opening 30, serving as an outlet opening, in the rear partition 26 of the relevant chamber. The respective blade 33 is designed in such a manner that it separates the inlet opening from the outlet opening within the relevant chamber, specifically in such a manner that the items of laundry 11 can pass from the concave rear side of the blade 33, which faces towards the inlet opening, to the opposite, convex front side thereof, only by the drum 12 rotating together with the chambers through a complete circle (360°).

The blades 33 are preferably designed to be completely impermeable to liquid. They are connected, preferably welded to the partitions 26 and the cylinder jacket 25 of the drum 12, in such a manner that the connecting points are essentially liquid-tight.

The partitions 26 of at least some chambers, in particular the washing chambers 18 and/or the rinsing chambers 19, are at least partially permeable to liquid. For this purpose, a perforation 34 comprising a uniform grid of through-holes may be provided. Similarly, at least part of the circumference of the drum 12 can be provided with the perforation 34. This perforation 34 can be located on the circumference of all chambers, or just of some selected chambers, for example, of the washing chamber 18 and/or the rinsing chamber 19. The perforations 34 are arranged in the drum 12 and/or the partitions 26 in such a manner that liquids, in particular washing liquids or rinsing liquids, can flow along through the drum 12 counter to the treatment direction 17 during the washing and/or rinsing of the items of laundry 11. In addition, through the cylinder jacket 15 of the drum 12, which cylinder jacket is at least partially provided with the perforation 34, washing and/or rinsing liquid can be drawn off, namely let out, from the relevant chamber, when required.

The method according to the invention will be described in greater detail below with reference to the manner of operation of the above-described continuous-process washing machine 10:

The drum 12 is driven in a manner such that it pivots to and fro during the treatment of the items of laundry, the drum 12 being rotated in an alternating manner in the one or other direction over part of its circumference. The drum 12 does not therefore execute a revolving circular movement during the treatment of the items of laundry 11. During the treatment of the items of laundry the openings 30 in the partitions 26 are always situated in an upper region of the drum 12, as a result of which the items of laundry 11 and, if appropriate, also the treatment liquid, always remain in the same chamber of the washing zone 14, the rinsing zone 15 and the finishing zone 16.

After the treatment in the particular chamber is completed, the items of laundry 11 are transferred into the next chamber in the treatment direction 17 According to the invention, this transfer of the items of laundry 11 takes place without the treatment liquid which is not tied up in the items of laundry 11, i.e., without the "free detergent solution". Therefore, only the items of laundry 11 together with the adhering liquid (tied-up detergent solution) are transferred from one chamber to the other, specifically preferably during a respective pause in treatment. In order, during the transfer of the items of laundry 11, together with at least part of the tied-up detergent solution, that the items of laundry 11 do not become hooked on the partitions 26 of the inter-adjacent chambers, the partitions 26 are of closed design, apart from the respective opening 30 for the transfer of the items of laundry 11, or are provided just with the perforation 34 which does not cause any problems during the transfer of just the items of laundry 11. A further particular characteristic in order to bring about a stoppage-free or residue-free transfer just of the items of laundry 11 without free detergent solution, resides in the fact that the respective opening 30 extends approximately as far as the central point, situated on the longitudinal central axis 13, of the respective partition 26 and otherwise the central point region of the drum 12 is closed between adjacent chambers by the partition 26.

In order to be able to transfer the items of laundry 11 without the free detergent solution, the treatment liquid, specifically in particular water, which may be mixed with detergent residues and/or dirt, is let out. The letting-out of the treatment liquid expediently takes place in that chamber from which the items of laundry 11 are to be transferred without the free detergent solution into the following chamber. For this purpose, the treatment liquid is let out of that cylinder section 28 of the outer drum 23 which is assigned to the respective chambers by being transported to another location or being first of all temporarily stored in a storage tank. When the treatment liquid is let out of the outer drum 23, the treatment liquid which is situated in the region of the respective chambers within the drum 12 passes through the perforation 34 in the cylinder jacket 25 of the drum 12 into the outer drum 23, from where the treatment liquid is removed. The removal of the treatment liquid expediently takes place before the beginning of the transfer of the items of laundry 11 from the relevant chamber into the following chamber. This may, for example, take place in a final phase of the treatment of the items of laundry 11.

The drum 12 preferably continues to be driven in a rotating manner, in particular pivoting manner, after the free detergent solution has been let out of the relevant chamber. The drum 12 then executes the same movements which it undertakes in order to wash or rinse the items of laundry 11. The movements can preferably take place more rapidly, at other angles of rotation and also with greater decelerations and/or accelerations. As a result, some of the detergent solution tied up in the items of laundry 11 can be separated from the items of laundry 11, specifically in the manner of a spinning process. This original tied-up detergent solution can then also pass like the free detergent solution out of the drum 12 to the outer drum 23 and can be let out there. The items of laundry 11 are then transferred with a reduced, tied-up detergent solution. This results in the transfer of the portion of the treatment liquid from the one chamber to the other chamber, in particular from the one treatment zone to the other treatment zone, taking place with the smallest possible amount of treatment liquid from the preceding treatment.

The items of laundry 11 are preferably transferred without the free detergent solution, and if appropriate with a reduced amount of tied-up detergent solution, from the washing zone 14, in particular the clear washing zone located at the end thereof, to the rinsing zone 15. The free detergent solution, and if appropriate some of the tied-up detergent solution, is preferably removed for this purpose from the last chamber of the washing zone 14, in particular the clear washing zone, before the items of laundry 11 are transferred without the free detergent solution, and if appropriate with a reduced amount of tied-up detergent solution, into the next chamber, namely the first chamber of the rinsing zone 15.

What is claimed is:

1. Method for washing items of laundry using a treatment liquid in a rotary-driven drum having successive treatment chambers arranged in a longitudinal direction, wherein the items of laundry are conducted along in a treatment direction through the successive treatment chambers of the drum, comprising the steps of: (a) separating the treatment liquid from the items of laundry in the relevant chamber during a final phase of treatment; (b) transferring the items of laundry (11) from the relevant chamber to a following chamber essentially without the treatment liquid, namely, any free detergent solution that is not tied up in the items of laundry (11); and (c) driving the drum in a respective operational mode while separating the treatment liquid from the items of laundry, whereby essentially only the items of laundry (11) are transferred form the relevant chamber to the following chamber.

2. Method according to claim 1, characterized in that the free detergent solution is separated from the items of laundry (11) before the items of laundry are transferred to a rinsing zone.

3. Method according to claim 2, characterized in that the free detergent solution is separated from the items of laundry (11) before the items of laundry are transferred to a first rinsing chamber (19).

4. Method according to claim 2, characterized in that before the items of laundry (11) are transferred into the following chamber, the items of laundry (11) are separated from a substantial portion of the free detergent solution in the preceding chamber.

5. Method according to claim 1, characterized in that the free detergent solution is drawn off from a washing chamber (18) before the items of laundry (11) are transferred into a following rinsing chamber (19).

6. Method according to claim 1, characterized in that the drum (12) continues to be driven for a time period after the free detergent solution has been drawn off from the relevant chamber.

7. Method according to claim 6, characterized in that the drum (12) continues to be driven for the time period in an operating mode of the drum (12) after the free detergent solution has been drawn off from the relevant chamber.

8. Method according to claim 1, characterized in the items of laundry (11) are transferred without the treatment liquid into the following chamber at the start of a rinsing zone.

9. Method according to claim 1, characterized in that, in order to transfer essentially only items of laundry (11) from a washing zone of at least one chamber, the drum (12) is driven in a rotating manner differing from the manner used in the washing zone.

* * * * *